United States Patent [19]

Henkel et al.

[11] 4,086,877

[45] May 2, 1978

[54] METHOD OF OPERATING AN INTERNAL COMBUSTION ENGINE FED WITH A REFORMED GAS

[75] Inventors: Hans-Joachim Henkel; Eugen Szabo De Bucs, both of Erlangen, Germany

[73] Assignee: Siemens Aktiengesellschaft, Munich, Germany

[21] Appl. No.: 647,104

[22] Filed: Jan. 7, 1976

[30] Foreign Application Priority Data

Jan. 14, 1975 Germany ..... 2501250

[51] Int. Cl.[2] ..... F02B 43/08

[52] U.S. Cl. ..... 123/1 A; 123/3; 123/DIG. 12

[58] Field of Search ..... 123/1 A, 3, DIG. 12, 123/59 EC; 60/39.12, 39.46 G; 48/197 R; 252/373

[56] References Cited

U.S. PATENT DOCUMENTS

| | | | |
|---|---|---|---|
| 1,957,743 | 5/1934 | Wietzel et al. | 48/197 R |
| 3,828,736 | 8/1974 | Koch | 123/1 A |
| 3,976,034 | 8/1976 | Shinohara et al. | 123/1 A |
| 3,986,350 | 10/1976 | Schmidt | 123/3 |

*Primary Examiner*—Charles J. Myhre
*Assistant Examiner*—Craig R. Feinberg
*Attorney, Agent, or Firm*—Kenyon & Kenyon, Reilly, Carr & Chapin

[57] ABSTRACT

A fuel gas obtained in a reformed gas generator through the catalytic reaction of hydrocarbons and a gas containing oxygen and provided to an internal combustion engine has its heat content along with that of the exhaust gas of the engine used to convert methonal endothermically into a gas mixture containing carbon monoxide and hydrogen with the gas mixture so formed fed to one or both the reformed gas generator and, along with the fuel gas, the internal combustion engine.

21 Claims, 4 Drawing Figures

METHOD OF OPERATING AN INTERNAL COMBUSTION ENGINE FED WITH A REFORMED GAS

BACKGROUND OF THE INVENTION

This invention relates to internal combustion engines fed with a fuel gas obtained in a reformed gas generator in general and more particularly to an improved method of operation for such internal combustion engines.

Methods of operating internal combustion engines with a fuel gas obtained from a gas generator rather than with a liquid fuel are known. Such methods are used because liquid fuel leads to incomplete combustion in the internal combustion engine. This is the result of insufficient carburation and poor mixing with combustion air leading to the presence of harmful substances in the exhaust gas. Antiknock agents which are mixed to the fuel result in additional pollutants which are injurious to the health. The level of harmful emissions to the air from an internal combustion engine can be substantially reduced if the engine is operated with a fuel gas obtained, for example, from the reaction of a liquid hydrocarbon fuel and an oxygen containing gas in a reformed gas generator.

The type of gas generator which is being referred and the manner of operating such is described, for example in U.S. application Ser. No. 633,609 filed Nov. 20, 1975 which is a continuation in part of U.S. application Ser. No. 439,870 filed Feb. 6, 1974 now abandoned. In the method disclosed therein atomized or evaporated liquid fuel containing hydrocarbons is fed, after having air and/or exhaust gas fed back from the internal combustion engine mixed with it, to the reaction chamber of a reformed generator where it is catalytically reacted to form a fuel gas containing carbon monoxide, carbon dioxide, methane and/or hydrogen. This fuel gas burns more completely in the internal combustion engine and results in an extremely low level of harmful exhaust gases. Furthermore, it has a high octane number making the addition of antiknock agents unnecessary.

For use in an internal combustion engine, fuel gas containing carbon monoxide and methane is desireable because of the high calorific value of this mixture. A fuel gas can be burned in the combustion chamber of the engine more completely and with better control if it contains hydrogen. Furthermore, in order to achieve sufficient filling of the combustion chamber of the internal combustion engine with fuel gas, it is desireable to feed a fuel gas which is as cool as possible. It is very difficult to fulfill all these requirements which the fuel gas should simultaneously meet. Furthermore, if the reaction of hydrocarbons with a gas containing oxygen takes place at low temperatures, up to the thermal equilibrium, soot occurs. Formation of soot, however, can lead to the destruction of the catalyst or even damage or destruction of the internal combustion engine and must be prevented through the use of suitable catalysts. In some circumstances, this requires a toleration of levels of carbon monoxide, methane and hydrogen in the fuel gas produced which does not meet what are considered as the most favorable combustion properties.

In view of these various problems, the need for an improved method of operating an internal combustion fed with a reformed fuel gas becomes evident.

SUMMARY OF THE INVENTION

The present invention provides such an improved method. The above noted problems are solved by utilizing the heat content of the fuel gas and exhaust gas respectively to convert methane endothermically into a gas mixture containing carbon monoxide and hydrogen. This gas mixture is fed to one or both the reformed gas generators and, along with the fuel gas, the internal combustion engine.

The carbon monoxide and hydrogen formed by the decomposition of the methonal has two possible uses. It can be used in the internal combustion engine and in the reformed gas generator. In the internal combustion engine a higher content of carbon monoxide and hydrogen in the fuel gas results in an increase of the octane number and the calorific value. By providing a higher hydrogen content in the gases in the reformed gas generator, a higher yield of methane and a compensation for the hydrogen deficit which prevails in the reaction of hydrocarbons with a lack of oxygen and favors the formation of soot is obtained. Through an endothermic conversion of the methonal heat is removed from the exhaust gas of the internal combustion engine or from the fuel gas with the heat so removed converted into chemical energy.

It is advantageous if the methanol is thermally decomposed since such a process requires only a minimum of apparatus and is extremely trouble free. It is preferred that the methanol be decomposed by spraying it into the hot fuel gas coming out of the reformed gas generator. In this manner the fuel gas is cooled and at the same time enriched with hydrogen and carbon monoxide before reaching the internal combustion engine. Furthermore, a part of the enriched fuel gas can be fed back into the reformed gas generator to great advantage. If such is done, the decomposed methanol products carbon monoxide and hydrogen, particularly the hydrogen, reduce the danger of soot formation and the quality of the fuel gas produced is improved.

Various embodiments of the method are illustrated. The methanol can be evaporated through a heat exchange with the exhaust gas of internal combustion engine. If the heat of evaporation is extracted from the exhaust gas, what would normally be waste heat is at least partially converted into chemical energy. On other hand if the heat of the fuel gas being fed to the internal combustion engine is used for evaporating the methanol, the fuel gas is cooled by the methanol decomposition at most to the reaction temperature and is cooled still further before entering the internal combustion engine to result in better filling of the combustion chambers.

All that is required for implementing these methods in which the methanol is thermally decomposed is basically a supply tank and an injection device for the methanol. The advantage of the simplicity of the construction of the apparatus for carrying out the thermal decomposition of methanol is counteracted by the fact that it takes place only at higher temperatures. This means that the fuel or exhaust gas can only be incompletely cooled. Furthermore, in some cases, the gases will not be hot enough to carry out the thermal decomposition of methanol.

Thus, in another embodiment of the method the methanol is catalytically reacted with water in a reformer heated by the fuel gas or exhaust gas. To carry out this catalytic reaction, catalysts normally used in the chemical industry for the synthesis of methanol under high pressure used. The same catalyst will result in the endothermic decompositon of the methanol into CO and $H_2$ at low pressure. These processes also take place at lower temperature and can be used for cooling purposes due to their heat demand.

When using such a method it is to advantage that the methanol and water be conducted into the methanol reformer with fuel gas and that the gas mixture produced therein be fed to the internal combustion engine. In such a case the methanol reformer will be directly heated by the fuel gas which is fed into it from the reformed gas generator. It is, however, also possible to heat the reaction chamber from the outside using the hot fuel gases from the reformed gas generator. The reaction chamber of the methanol reformer can also be heated from the outside using hot exhaust gases from the internal combustion engine. This last possibility is preferably over the direct heating by the fuel gas from the reformed gas generator where the operation of the methanol reformer would be disturbed by large quantities of fuel flowing through it.

Heating by the fuel gas is indicated in those cases where cooling the fuel gas is important. On the other hand, since the exhaust gases of the internal combustion engine generally have a higher temperature than the gases generated in the reformed gas generator, a methanol reformer heated by exhaust gas is advisable if the primary object is to utilize the waste heat of the internal combustion engine. In such embodiments a portion of the reformed gas from the methanol reformer can be mixed with the fuel gas. By doing this a fuel gas with a higher carbon monoxide and high hydrogen content and thus with a higher octane member and higher calorific value will be fed to the internal combustion engine. As with the previously mentioned embodiments it can of advantage to feed back a portion of the gas mixture leaving the methanol reformer to the reformed gas generator. This improves the composition of gas leaving the reformed gas generator and counteracts the potential danger of soot formation.

Preferably the methanol and/or water being fed to the methanol reformer will be evaporated and preheated through heat exchange with the exhaust of the internal combustion engine or the hot gas coming from the reformed gas generator. The heat which is contained in the exhaust gas or is to be removed for cooling of the fuel gas will thereby be more fully utilized and, in addition, the reaction in the methanol reformer can be controlled better through the use of gaseous starting materials.

DETAILED DESCRIPTION OF THE PREFERRED EMBODIMENT

Figure 1:
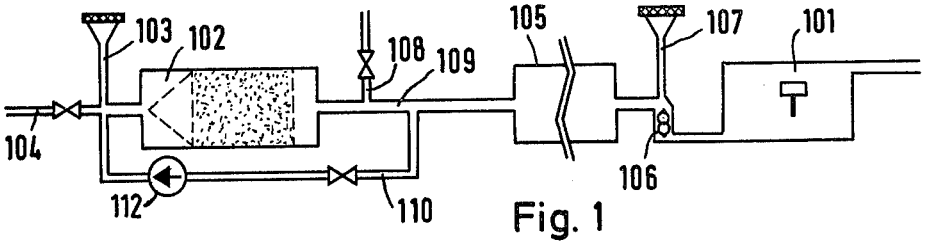
FIGS. 1–4 are schematic illustrations of four different arragnements for implementing the method of the present invention.

FIG. 1 illustrates a first embodiment for implementing the method of the present invention. An internal combustion engine 101 is supplied with a reformed fuel gas from a reformed gas generator 102 of the type described in the aforementioned, copending applications. Evaporated or atomized hydrocarbon fuel is supplied over a line 104 and oxygen containing gas supplied over a line 103 to the reformed gas generator 102. These components are drawn in by the internal combustion engine which is coupled to the output line 109 of the reformed gas generator 102 through apparatus to be more fully described below. Within the reformed gas generator 102 the hydrocarbon fuel and oxygen containing gas are converted into a fuel gas mixture containing substantially carbon monoxide, carbon dioxide, methane and/or hydrogen. This gas mixture flows out of the reformed gas generator through line 109 to a cooler 105 from which it is supplied to the engine through a mixing device 106 where it is mixed with additional combustion air drawn in over the line 107. In accordance with the present invention, methanol is sprayed into the line 109 from the line 108. The methanol sprayed into the line 109 is thermally decomposed by the hot fuel gas coming out of the reformed generator 102. It is thermally decomposed into hydrogen and carbon monoxide in the manner described above, at the same time cooling the fuel gas. A portion of the gas mixture which results from this decomposition and the mixing of the decomposition products with the reformed fuel gas is fed back over the line 110 to the inlet of the reformed gas generator 102. The remainder is fed through the cooler 105 to the internal combustion engine 101. For control of the amount of the mixture which is fed back, a metering valve is provided.

In addition, a compressor 112 is arranged in the return line 110. This can be an exhaust gas turbo charger of a type well known in the automotive art. In installations where the gas which is drawn through the reformed gas generator suffers only a small pressure loss it may also be possible to design the junction of the feedback line 110 with the reformed gas generator 102 as a steam jet suction pump. The air drawn in through the air intake line 103 then produces the suction which acts as the driving medium necessary for returning the gas mixture from the output of the reformed gas generator on line 109 through the feedback line 110.

In the manner described in the aforementioned application, a portion of the exhaust gas can also be conducted back to the air intake line 104 in order to supply the reformed gas generator with an air and exhaust mixture acting as the gas containing oxygen. Furthermore, the reformed gas generator 102 may be heated by the engine exhaust through the use of a heat exchanger. The cooler 105 may also be used to advantage for evaporating the hydrocarbon fuels supplied on the fuel line 104. These are measures known in the art and are not illustrated or described in detail. Furthermore, to obtain homogeneity of the mixture, the air and exhaust gas mixture where used can be drawn into the inlet of the reformed gas generator 102 through a mixer disposed at the input of the reformed gas generator prior to entering its reaction chamber. In conventional fashion, the reaction chamber will contain a catalyst applied, for example, to sintered bodies or a catalyst in a bed of filler material and at which the conversion of the gas mixture into gas fuel gas takes place.

Further auxiliary devices such as, for example, compressors or control units may also be advantageous. For example, supplemental heating means for warming up and the quick starting of a cold installation may be installed along with means to evaporate the fuel in the line 104, control means being provided to inject the methanol and feedback exhaust gas only at a later time. Once again, the types of controls necessary to carry out such functions are described in detail in the aforementioned specification. Furthermore, since a definite temperature range should be maintained in reformed gas generator 102 to maintain the catalytic reaction it may also be advantageous to control the quantity of the gas which is to be introduced into the reformed gas generator through the line 110. As noted above, this gas is cooled by the decomposition of the methanol. Thus, control of this quantity as a function of temperature in the reaction chamber is desireable.

Figure 2:
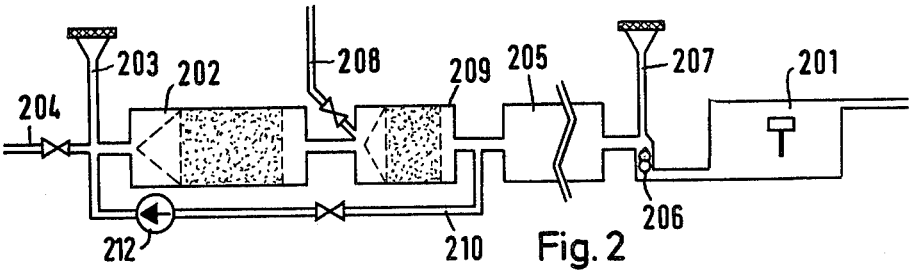

FIG. 2 illustrates another embodiment for carrying out the method of the present invention. The arrangement is essentially as shown on FIG. 1 with the internal combustion engine 201 drawing in an oxygen containing gas over line 203, and a hydrocarbon fuel gas over line 204 and additional combustion air over line 207, reformed fuel gas and the additional combustion air being mixed in the mixer 206. Once again, a reformed gas generator 202 is interposed between the input lines and the internal combustion engine. As in the previous embodiment, a cooler 205 is provided. The main difference in this embodiment is that, rather than spraying the methanol directly into the line 109, a methanol reformer 209 in series with the reformed gas generator 202 and the cooler 205 is provided. The hot gases leaving the reformed gas generator 202 are fed directly into the methonal reformer 209. The reformer contains a conventional catalyst and is heated by these hot fuel gases. A water and methonal mixture is sprayed into the methonal reformer through the line 208. As an alternate, water and methonal can be injected through separate lines. The gas mixture produced by the catalytic decomposition of the methonal is conducted partially into the cooler 205 and partially into the reformed gas generator 202 through the line 210. The water and methonal can be injected in liquid form into the reformer 209 through the line 208 or can be first evaporated, for example, in the cooler 205 through heat exchange with the fuel gas. As an alternate, they can be vaporized through use of the exhaust gas from the internal combustion engine.

Figure 3:
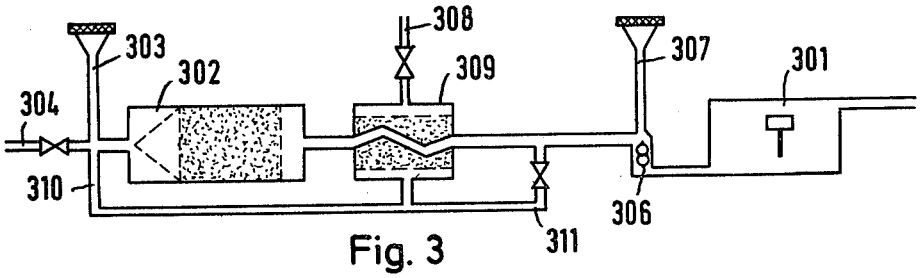

FIG. 3 illustrates a further embodiment of the present invention. Once again, the same basic elements such as the internal combustion engine 301, hydrocarbon fuel gas supply line 304, oxygen containing gas line 303, reformed gas generator 302, combustion air inlet 307 and mixer 306 are provided. The significant difference in this emboidment is that the cooler is eliminated and the methonal reformer 309 has the hot fuel gases from the reformed gas generator passing therethrough to supply heat but in a manner such that it is not in contact with the gases in the methonal reformer. Methanol and water are supplied to the methonal reformer 309 over the line 308. After conversion therein through a catalytic reaction with the catalyst heated by the hot fuel gases, the resulting mixture is partially fed back over the line 310 to the inlet to the reformed gas generator 302 with the remainder fed over line 311 to the inlet line 306 containing the reformed fuel gas.

Figure 4:
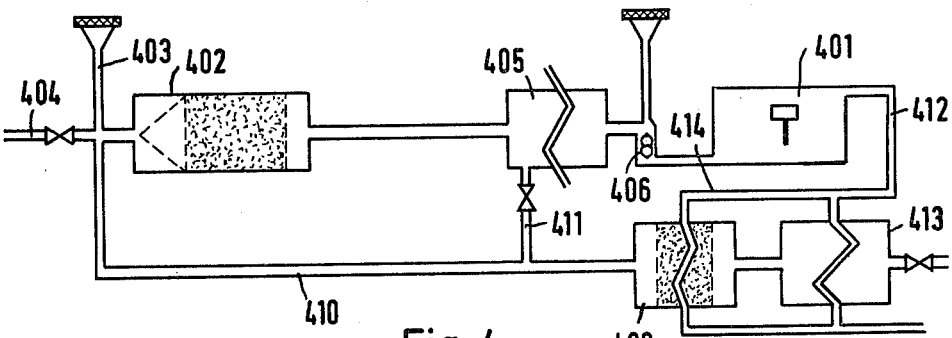

The arrangement shown in FIG. 4 again has the same basic elements as in FIG. 1. These include the hydrocarbon fuel inlet 404, oxygen containing gas inlet line 403, reformed gas generator 402, cooler 405, mixer 406, and internal combustion engine 401. In this embodiment the methonal reformer is heated by the exhaust gas from the internal combustion engine rather than by the fuel gas from the reformed gas generator. Thus, the exhaust gas line 412 of the internal combustion engine is coupled to the methonal reformer 409 to heat the catalyst therein. Methonal and water are supplied to the methonal reformer through an additional heat exchanger 413 also coupled to a branch of the exhaust gas line 412. This results in the use of the exhaust gas to atomize the methonal and water before they enter the reformer 409. As with the embodiment of FIG. 3, a portion of the reaction products from the methonal reformer is fed back over the line 410 to the inlet of the reformed gas generator 402 with the remainder fed over the line 411 to the cooler 405 where it is mixed with the reformed gas and fed to the internal combustion engine 401 after passing through the mixer and being mixed with further combustion air.

It will be evident to those skilled in the art that various modifications of the basic method other than those illustrated may be made. For example, it is possible in the embodiment of FIG. 4 to evaporate the methonal and water in the heat exchanger 405 rather than in a separate heat exchanger 413. Furthermore, where the fuel gas is to be used in gas turbines or in a stationary reciprocating engine where a poor filling factor can be tolerated, the cooling of the reformed fuel gas is unnecessary. In the latter case the poor filling factor which occurs when hot fuel gas is used can be compensated by an increase in displacement volume. In such cases it is advantageous to use the exhaust gas in the heat exchanger for evaporating purposes and for heating the methonal reformer. This increases the efficiency of the overall apparatus by utilizing all of the exhaust gas heat. These and other modifications may be made without departing from the spirit of the invention which is intended to be limited solely by the appended claims.

What is claimed is:

1. A method of operating an internal combustion engine with a fuel gas which is obtained by the catalytic reaction of hydrocarbons and a gas containing oxygen in a reformed gas generator comprising the steps of:

(a) endothermically converting methanol into a gas mixture containing carbon monoxide and hydrogen utilizing the heat content of at least one of the group of gases consisting of the fuel gas from the reformed gas generator and the exhaust gas from the internal combustion engine to thereby convert that heat content to useable chemical energy;

(b) mixing said gas mixture with at least one of the group consisting of the hydrocarbons and the fuel gas; and (c) feeding the gas mixture along with the fuel gas and combustion air to the internal combustion engine for combustion therein.

2. The method according to claim 1 wherein said step of converting is carried out utilizing the heat content of the exhaust gas from the internal combustion engine.

3. The method according to claim 1 wherein said step of converting is carried out utilizing the heat content of the fuel gas from the reformed gas generator.

4. The method according to claim 1 wherein said step of mixing comprises mixing the gas mixture with the fuel gas and further including the step of feeding a portion of the fuel gas mixed with the gas mixture back into the reformed gas generator.

5. The method according to claim 1 wherein said step of endothermically converting is a step of thermal decomposition.

6. The method according to claim 5 wherein said methanol which is to be decomposed is sprayed into the hot fuel gas coming from the reformed gas generator.

7. The method according to claim 5 and further including the steps of evaporating the methanol prior to decomposition.

8. The method according to claim 7 wherein said step of evaporating the methanol comprises evaporating through a heat exchange with the exhaust gas of the internal combustion engine.

9. The method according to claim 7 wherein said step of evaporating comprises evaporating through a heat exchange with the fuel gas being fed to the internal combustion engine.

10. The method according to claim 1 wherein said step of endothermic conversion is a step of catalytically reacting methanol and water in a reformer which is heated.

11. The method according to claim 10 wherein said methanol and water are supplied to said methanol reformer mixed with the hot fuel gas from said reformed gas generator and the gas mixture produced in said methanol reformer is fed to the internal combustion engine.

12. The method according to claim 10 wherein a portion of the gas mixture formed in the methanol reformer is conducted back to the reformed gas generator.

13. The method according to claim 10 wherein the reaction of the methanol reformer is heated from the outside by the hot exhaust gases from the internal combustion engine.

14. The method according to claim 13 and further including the step of mixing a portion of the gas formed in the methanol reformer with the fuel gas from said reformed gas generator.

15. The method according to claim 13 wherein a portion of the gas mixture formed in the methanol reformer is conducted back to the reformed gas generator.

16. The method according to claim 10 wherein said methanol reformer is heated from the outside by the hot fuel gas from said reformed gas generator.

17. The method according to claim 16 wherein a portion of the gas mixture formed in the methanol reformer is conducted back to the reformed gas generator.

18. The method according to claim 16 and further including the step of mixing a portion of the gas formed in the methanol reformer with the fuel gas from said reformed gas generator.

19. The method according to claim 18 wherein a portion of the gas mxiture formed in the methanol reformer is conducted back to the reformed gas generator.

20. The method according to claim 10 and further including the step of preheating at least one of the methanol and water fed to said methanol reformer.

21. The method according to claim 20 wherein said step of preheating is carried out through a heat exchange with the exhaust of the internal combustion engine.

* * * * *